US005427570A

United States Patent [19]

Chen

[11] Patent Number: 5,427,570

[45] Date of Patent: Jun. 27, 1995

[54] EXHAUST HOOD SYSTEM

[76] Inventor: Ming-Jing Chen, No. 29, Alley 39, Lane 206, Sec. 2, Tai-Ho Rd., Ah-Yi Li, Changhua City, Taiwan

[21] Appl. No.: 207,061

[22] Filed: Mar. 8, 1994

[51] Int. Cl.[6] ..... B08B 15/02

[52] U.S. Cl. ..... 454/65; 285/166; 285/184; 454/197

[58] Field of Search ..... 454/63, 65, 197, 200, 454/341; 285/122, 166, 168, 184, 181

[56] References Cited

U.S. PATENT DOCUMENTS

| | | | |
|---|---|---|---|
| 505,250 | 9/1893 | Paietta | 454/197 |
| 877,420 | 1/1908 | Hackney | 454/197 |
| 1,695,263 | 12/1928 | Jacques | 285/166 X |
| 2,083,970 | 6/1937 | Walter | 285/168 |
| 2,278,356 | 3/1942 | Livingston | 285/184 X |
| 2,680,358 | 6/1954 | Zublin | 285/166 X |
| 2,729,473 | 1/1956 | Warshawsky | 285/184 X |

FOREIGN PATENT DOCUMENTS

| | | | |
|---|---|---|---|
| 526171 | 10/1921 | France | 285/184 |
| 2624689 | 1/1977 | Germany | 454/65 |
| 218843 | 1/1942 | Switzerland | 454/147 |
| 14890 | of 1891 | United Kingdom | 454/341 |
| 1530275 | 12/1989 | U.S.S.R. | 454/65 |

*Primary Examiner*—Harold Joyce

*Attorney, Agent, or Firm*—Morton J. Rosenberg; David I. Klein

[57] ABSTRACT

An exhaust hood system comprising an exhaust fan fastened to a window frame of a room and covered with a hood having an intake port coupled with a guide tube being fastened to the wall of the room by a holder, a series of universal connecting tubes linked together and connected to the guide tube by swivel connectors, and an exhaust connected to the series of universal connecting tubes for carrying smoke outside the room through the series of universal connecting tube upon operation of the exhaust fan, the series of universal connecting tubes being turnable and bendable for permitting the exhaust hood to be moved to the desired position and direction to suck in smoke.

3 Claims, 3 Drawing Sheets

EXHAUST HOOD SYSTEM

BACKGROUND OF THE INVENTION

The present invention relates to an exhaust hood system which includes a series of universal connecting tubes to connect an exhaust hood to an exhaust fan for permitting the exhaust hood to be moved to the desired position and direction to suck in smoke.

It has been apparent that smoking is harmful to the health. However, it is sometimes difficult to prohibit others from smoking. One may be secondarily polluted by smoke when there is other people smoking. Therefore, it is necessary to install exhaust hoods or ventilators in rooms, halls, public places, etc., to draw out smoke. However, regular exhaust hoods and ventilators are commonly of fixed type and cannot be adjusted to the source of smoke to effectively carry smoke away.

SUMMARY OF THE INVENTION

The present invention has been accomplished under the aforesaid circumstances. It is therefore the principal object of the present invention to provide an exhaust hood system which can be turned and bent to the desired position and direction to effectively carry smoke and turbid air out of a room or place. According to the preferred embodiment of the present invention, the exhaust hood system comprises an exhaust fan fastened to a window frame of a room and covered with a hood having an intake port coupled with a guide tube being fastened to the wall of the room by a holder, a series of universal connecting tubes linked together and connected to the guide tube by swivel connectors, and an exhaust connected to the series of universal connecting tubes for carrying smoke outside the room through the series of universal connecting tube upon operation of the exhaust fan. The series of universal connecting tubes is turnable and bendable, and therefore the exhaust hood can be moved to the desired position and direction to suck in smoke effectively.

DETAILED DESCRIPTION OF THE PREFERRED EMBODIMENT

Figure 1:
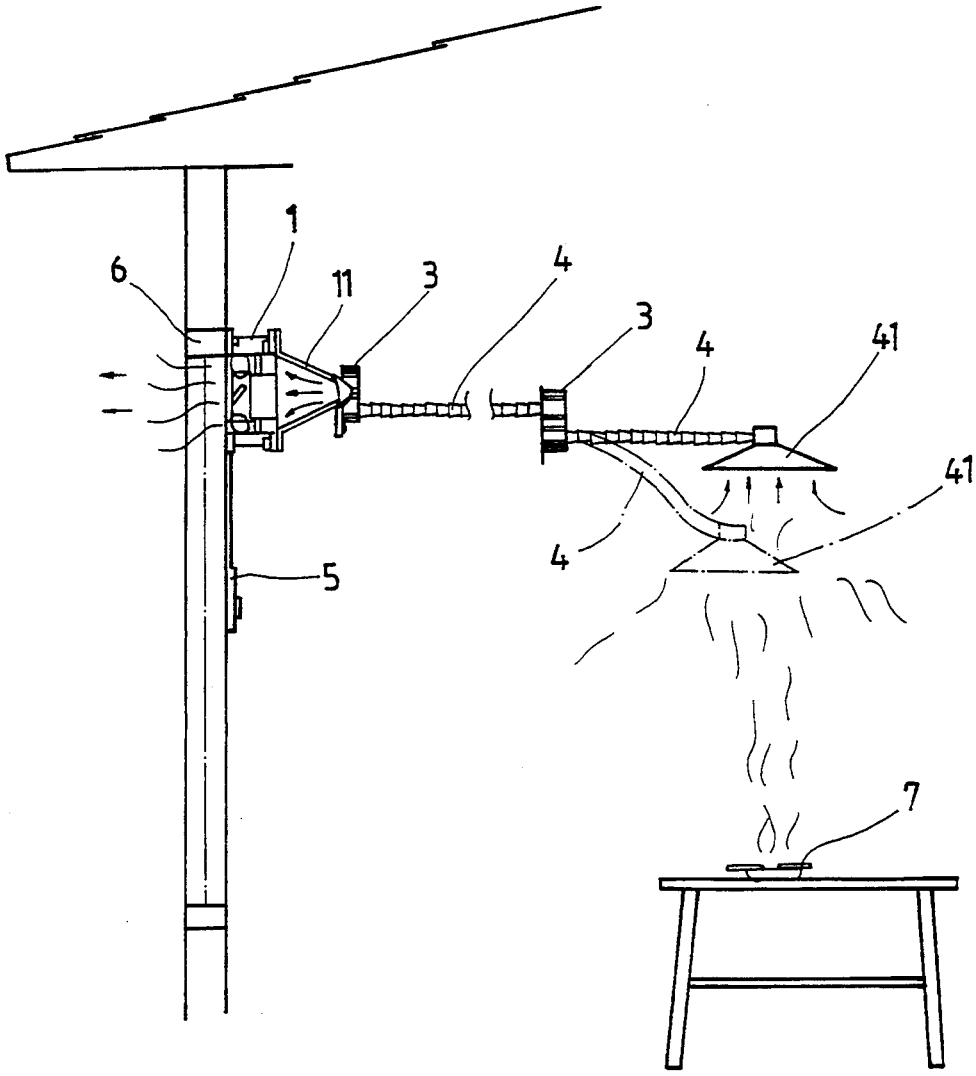
FIG. 1 is a plain view showing the installation of an exhaust hood system according to the preferred embodiment of the present invention.
Figure 2:
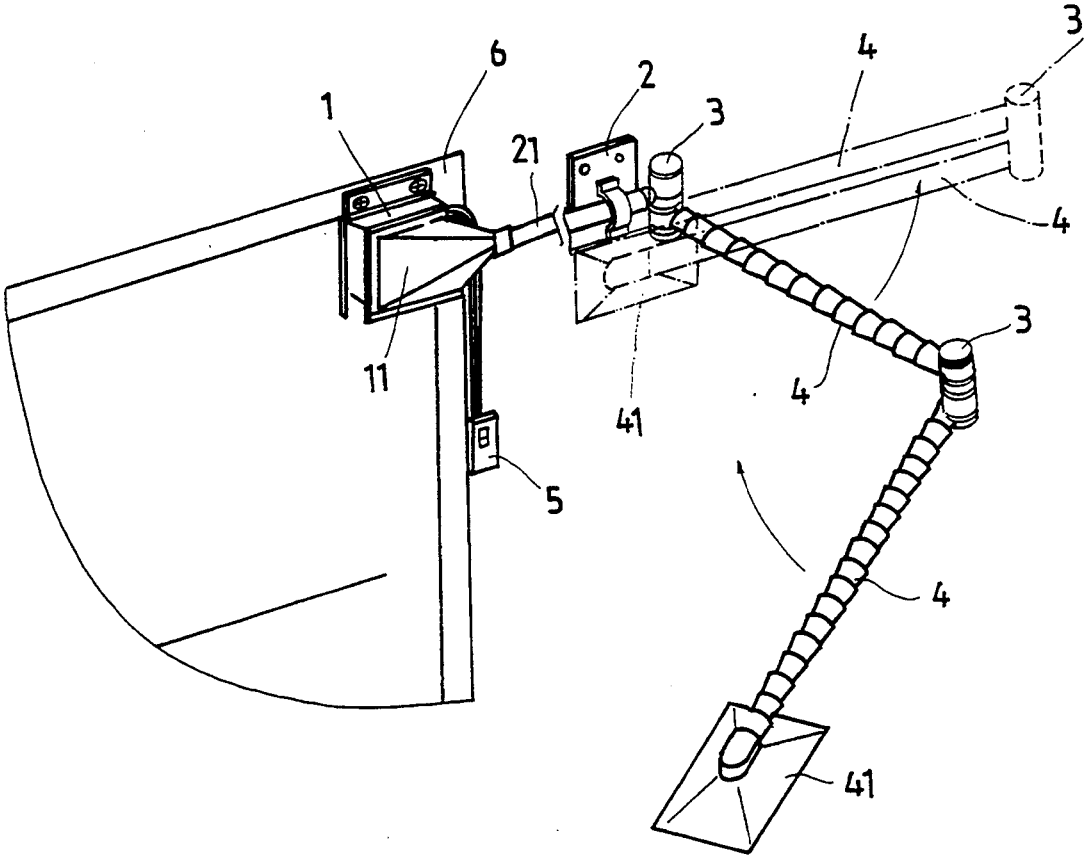
FIG. 2 is an elevational view of the exhaust hood system shown in FIG. 1.

Referring to FIGS. 1 and 2, an exhaust fan 1 is fastened to the window frame 6 at a suitable location and covered with a hood 11. The hood 11 has a hole (not shown) coupled with a guide tube 21. The guide tube 21 is fastened to the wall by a holder 2. A series of universal connecting tubes 4 are linked together and connected to the guide tube 21 by swivel connectors 3. The terminal end of the series of universal connecting tubes 4 is coupled with an exhaust hood 41. A power switch 5 is provided to control the operation of the exhaust fan 1. When the power switch 5 is switched on, the exhaust fan 1 is turned on to suck in air through the exhaust hood 41, causing the smoke of the burning cigarette 7 or the turbid air to be carried away from the room and exhausted to the outside. The universal connecting tubes 4 can be bent in all directions. Therefore, the exhaust hood 41 can be moved to the desired position and direction to suck in smoke. When the exhaust fan 6 does no work, the series of universal connecting tubes 4 can be folded up and put aside to the wall so as not to occupy much space.

Figure 3:
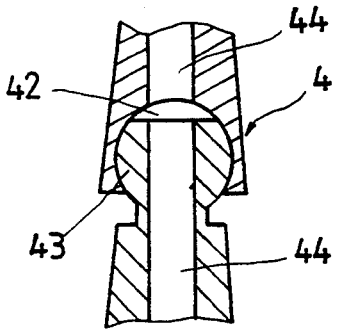
FIG. 3 is a cross section showing two tube sections of a universal connecting tube connected according to the present invention.

Referring to FIG. 3, the universal connecting tube 4 is comprised of a series of tube sections, each tube section having a front end terminating in a ball head 43 and a rear end terminating in a ball socket 42 and a longitudinal through hole 44 through the ball head 43 and the ball socket 42. The ball head 43 of one flexible tube section fitted into the ball socket 42 of another, and therefore the universal connecting tube 4 can be turned and bent in all directions.

Figure 4:
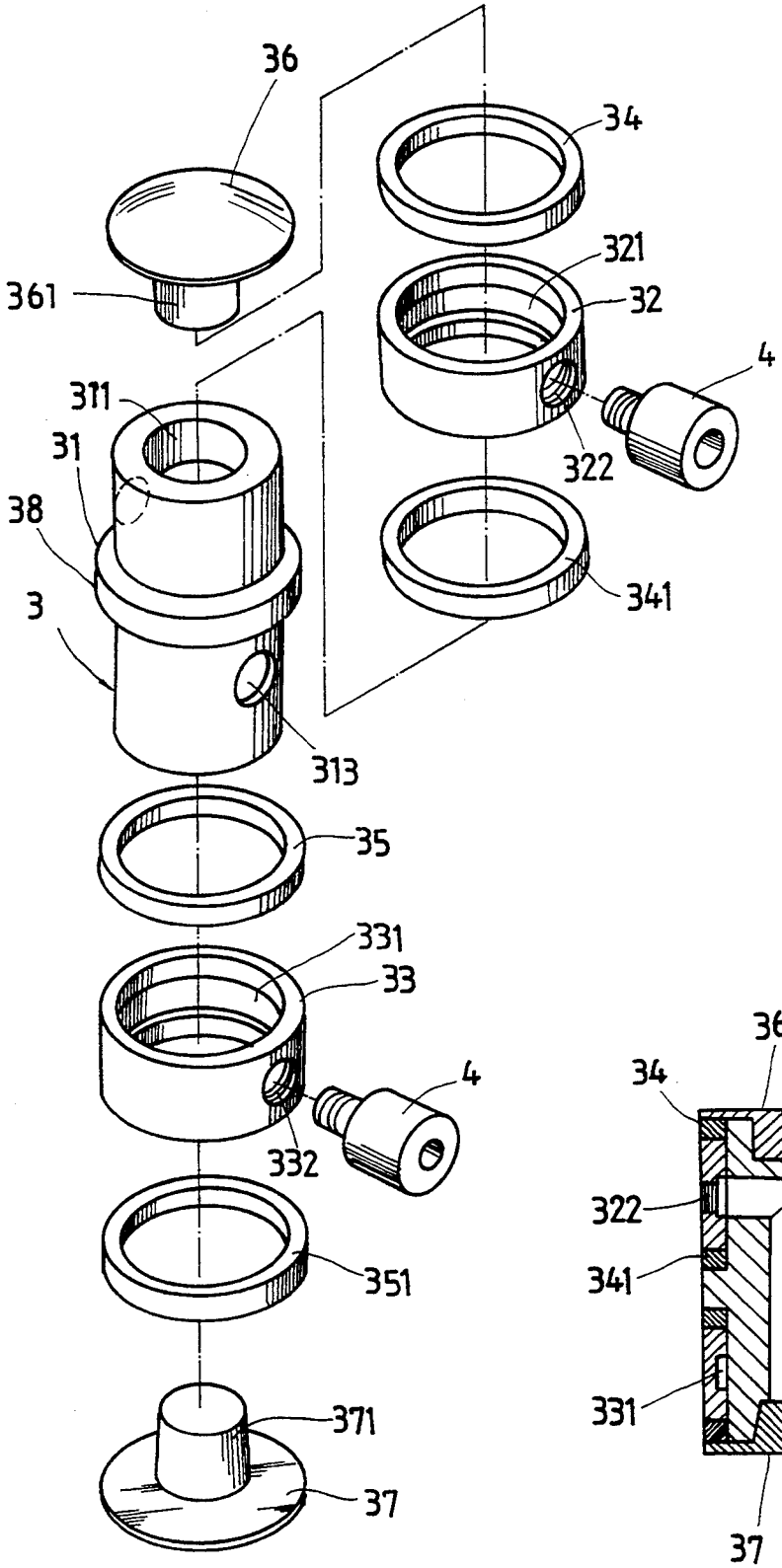
FIG. 4 is an exploded view of a swivel connector according to the present invention.
Figure 5:
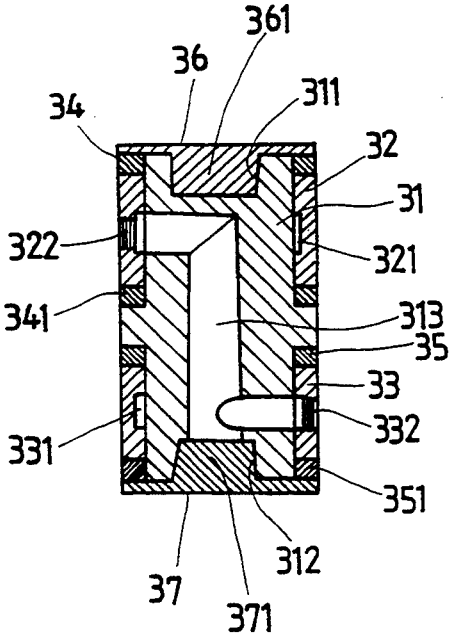
FIG. 5 is a longitudinal view in section of the swivel connector shown in FIG. 4.

Referring to FIGS. 4 and 5, the swivel connector 3 comprises a cylindrical connector body 31, which has a collar 38 raised around the periphery thereof in the middle, two opposite end holes 311;312 on two opposite ends thereof, and an air passage hole 313, two rotating rings 32;33 respectively mounted around the connector body 31 and retained between a respective pair of locating rings 34;341 or 35;351 at two opposite sides by the collar 38, and two end caps 36;37 having a respective plug rod 361 or 371 fitted into either end hole 311 or 312. The rotating ring 32 or 33 has an inside annular groove 321 or 331 disposed in communication with the air passage hole 313 at either end, and a screw hole 322 or 332 disposed in communication with the inside annular groove 321 or 331 for connecting a respective universal connecting tube 4. Therefore, when the rotating ring 32 or 33 is turned in either direction by the linked universal connecting tube 4, intake smoke is still allowed to pass from one universal connecting tube 4 through the inside annular groove 331 of the lower rotating ring 33 and the air passage hole 313 of the connector body 31 to another universal connecting tube 4 via the inside annular groove 321 of the upper rotating ring 32.

While only one embodiment of the present invention has been shown and described, it will be understood that various modifications and changes could be made without departing from the spirit and scope of the invention.

What is claimed is:

1. An exhaust hood system for coupling to a window frame of a room, comprising:

a displaceable exhaust hood for ventilating a room;

an exhaust fan fastened to the window frame;

a hood covering said exhaust fan and having an intake port formed therethrough;

a guide tube secured to a wall of the room adjacent the window frame, said guide tube being coupled in fluid communication with said intake port; and, adjustment means coupled in fluid communication between said exhaust hood and said guide tube, said adjustment means including (1) a first swivel connector having an output port coupled to said guide tube, (2) a plurality of universal connecting tubes coupled one to another in series relationship, one end of said series coupled universal connecting tubes being coupled to an inlet port of said first swivel connector and an opposing end being coupled in fluid communication with said exhaust hood, each of said plurality of universal connecting tubes being formed by a plurality of tube sections, each of said plurality of tube sections being pivotally coupled one to another to enable said universal connecting tube to be arcuately contoured in any of a plurality of directions, and (3) at least one second swivel connector coupled between two of said plurality of universal connecting tubes.

2. The exhaust hood system as recited in claim 1 where said first and second swivel connectors each include:

a longitudinally extended cylindrical connector body having a cylindrical wall member surrounding through bore extending longitudinally between opposing ends of said cylindrical body, said cylindrical body having a raised collar portion formed on an external surface of said cylindrical wall member intermediate said opposing ends, said cylindrical wall member having a pair of air passage holes formed therethrough, each of said pair of air passage holes being formed adjacent a respective one of said opposing ends;

a pair of ring members rotatably mounted on said external surface of said cylindrical wall member, each of said ring members being disposed adjacent a respective one of said opposing ends, each of said ring members being formed by an annular wall member having an annular groove formed in an inner surface of said annular wall member, said annular groove being in fluid communication with a respective one of said air passage holes, each of said annular wall members having a threaded opening formed therethrough in fluid communication with said annular groove for coupling with a respective one of said guide tube and said universal connecting tubes; and, a pair of end cap members, each of said pair of end cap members having a protruding plug portion disposed within said cylindrical body through bore on opposing ends thereof and a flange portion extending radially from said protruding plug portion for retaining a respective ring member on said cylindrical connector body.

3. The exhaust hood system as recited in claim 1 where each of said plurality of tube sections have a ball head formed on one end thereof and a ball socket formed in an opposing end for said pivotal coupling of one tube section to another.

* * * * *